United States Patent [19]

Schoonover

[11] Patent Number: 4,909,445

[45] Date of Patent: Mar. 20, 1990

[54] DESUPERHEAT FLOW NOZZLE

[75] Inventor: Kevin G. Schoonover, Atlanta, Ga.

[73] Assignee: Steam Systems and Service Incorporated, Atlanta, Ga.

[21] Appl. No.: 352,706

[22] Filed: May 10, 1989

Related U.S. Application Data

[63] Continuation of Ser. No. 88,573, Aug. 24, 1987, abandoned.

[51] Int. Cl.[4] ..... B05B 1/34

[52] U.S. Cl. ..... 239/463; 239/456; 239/584; 261/DIG. 13

[58] Field of Search ..... 239/463, 464, 462, 451, 239/456, 533.1, 583, 468, 469, 584, 533.12; 261/DIG. 13, 39.1; 137/625.12

[56] References Cited

U.S. PATENT DOCUMENTS

| | | | |
|---|---|---|---|
| 759,320 | 5/1904 | Schutte | 239/464 |
| 2,775,484 | 12/1956 | Fox | 239/464 |
| 3,022,954 | 2/1962 | Davies et al. | 239/463 |
| 3,524,592 | 8/1970 | Gustafsson | 137/625.12 |
| 4,130,611 | 12/1978 | Brand | 261/DIG. 13 |
| 4,442,047 | 4/1984 | Johnson | 261/DIG. 13 |

*Primary Examiner*—Andres Kashnikow
*Assistant Examiner*—Christopher G. Trainor
*Attorney, Agent, or Firm*—Jones, Askew & Lunsford

[57] ABSTRACT

A spray desuperheater maintaining a desired homogeneous spray pattern throughout the full range of operation, including relatively low rates of flow. Water flows to a spray orifice through a variable-geometry control which constricts at flow rates below the minimum flow required to maintain pressure control across the spray nozzle. This constricted flow increases the velocity of the water tangentially entering a spin chamber leading to the spray nozzle. The increased velocity of water at the lower rates of flow, combined with the spin imparted to the water, maintains the desired homogeneous spray pattern at the lower flow rates. The variable geometry control is fully open at flow rates sufficient to sustain pressure control at the spray nozzle, and a fixed-geometry control adjusts a higher range of flow rates.

15 Claims, 3 Drawing Sheets

DESUPERHEAT FLOW NOZZLE

This is a continuation of application Ser. No. 088,573, filed Aug. 24, 1987, now abandoned.

FIELD OF THE INVENTION

This invention relates in general to apparatus for desuperheating steam, and relates in particular to apparatus for introducing a flow of cooling liquid into steam.

BACKGROUND OF THE INVENTION

Steam generating systems frequently produce superheated steam and deliver that steam to utilization devices such as steam turbines or the like. Because superheated steam can reach temperatures which damage the utilizing devices or the superheaters itself, close control is maintained over the superheat temperature of the steam. There are several known techniques for controlling superheat temperature and desuperheating the steam where necessary, and one such technique is reducing the superheat temperature by injecting a water spray into the steam. This water spray reduces the superheat temperature by the amount of heat required to raise the injected mass of water to the vaporization temperature and then to vaporize the water.

A relatively close degree of control for superheat temperatures is desired in many applications. An effective desuperheat apparatus should modulate the flow of water or other desuperheat liquid over a range from the desired maximum flow down to a minimum flow rate. Because efficient desuperheating use of the injected water is maximized by reducing the size of water droplets and maintaining a desired spray dispersion pattern of those droplets into the steam flow, an effective desuperheat apparatus should maintain the desired spray dispersion and water droplet size over the full range of fluid flow rates. A spray dispersion pattern in the shape of a hollow cone spray has been found particularly effective for steam desuperheat applications.

Spray nozzles having a fixed geometry require some minimum pressure drop across the spray orifice to maintain the desired spray pattern. This minimum pressure drop is easily maintained at higher liquid flow rates, namely, flow rates at least sufficient to maintain a back pressure behind the nozzle orifice. However, as the desuperheat valve throttles the liquid flow rate below some particular minimum flow rate, the back pressure is no longer maintained and the pressure drop across the nozzle decreases. Consequently, the spray dispersion pattern becomes degraded and the individual water droplets making up the spray may become enlarged at relatively low rates of flow. These effects, in turn, reduce the efficiency of desuperheating at relatively low rates of water flow, because the water spray contains fewer droplets per unit volume and thus has a correspondingly reduced surface area, per unit volume of water, for receiving heat transfer from the superheated steam.

Prior art attempts to overcome the foregoing problems have generally used multiple spray nozzles, with one nozzle producing the desired spray dispersion pattern at relatively high rates of water flow and with another nozzle designed to produce an efficient spray pattern at the relatively low rates of flow. These multiple nozzle desuperheaters are mechanically more complex, requiring an operating mechanism coordinating and controlling the liquid flow to both nozzles, and also controlling the geometry of the one or both nozzles in some cases. Furthermore, it has been found that multiple nozzle desuperheaters sometimes produce overlapping sprays; these spray patterns impinge each other, producing larger water droplets which negate the purpose of a separate low-volume spray nozzle.

It is an object of the present invention to provide an improved spray desuperheat apparatus.

Another object of the present invention is to provide a spray desuperheat apparatus providing a substantially uniform spray dispersion pattern over a range of flows including relatively low flow rates.

It is still another object of the present invention to provide a spray desuperheat apparatus providing spin control of the spray pattern at relatively low flow rates, and providing pressure control of the flow pattern at relatively higher rates of flow.

The foregoing and other objects and advantages of the present invention will become more readily apparent below.

SUMMARY OF THE INVENTION

Stated in general terms, the present desuperheat apparatus has a single flow nozzle and utilizes spin flow control to create the condition necessary for producing the desired hollow cone spray dispersion pattern at lower flow rates, and uses pressure control of the spray pattern at relatively higher flow rates. Stated somewhat more specifically, a variable-geometry orifice controls water flow to the spray nozzles in the lower range of flow rates. This variable geometry orifice adjusts the cross-section area of the orifice as the rate of flow is changed, thereby adjusting the velocity of the desuperheat liquid flowing to the spray nozzle. The desuperheat apparatus induces a spin movement to the liquid flowing from the variable-geometry orifice to the spray nozzle, further accelerating the liquid flow to the spray nozzle. The variable-geometry orifice maintains the spin velocity relatively high over the lower range of desuperheat liquid flow, thereby maintaining a relatively constant spray dispersion pattern over that lower range. At liquid flows above the low end of the range, where the flow rate through the apparatus maintains a pressure drop across the spray nozzle at least sufficient to provide the desired spray pattern, a flow control element of fixed geometry varies the amount of liquid flowing through the desuperheat apparatus under given liquid supply conditions.

Stated somewhat more particularly, the present desuperheat apparatus imparts spin to the liquid entering the spray nozzle by introducing that liquid at a point substantially tangent to a hollow spin chamber leading to the spray nozzle. Liquid is admitted to the spin chamber through the variable-geometry orifice, which is calibrated to keep the spin velocity substantially constant independent of flow rate over the reduced-flow portion of the full range of flow rates for the desuperheat apparatus, assuming a constant water pressure supplied to the apparatus. The spin chamber thus maintains liquid flow to the spray nozzle at a velocity sufficient to maintain the desired flow dispersion pattern and droplet size substantially independent of flow, over the lower range of flow rates. The spin chamber continues operating after the variable-geometry orifice is fully opened, a condition existing only when the flow rate is sufficient to maintain enough back pressure behind the spray nozzle so as to provide the desired spray pattern irrespective of spin control.

Stated with more specificity, the variable-geometry flow control includes a tapered surface formed at an end of a valve control element selectively movable within an elongated passage. The tapered surface confronts a flow orifice leading to the spin chamber. The effective crosssection area of the orifice depends on the position of the control element relative thereto, so that the velocity of liquid flowing through the variable area of the orifice and entering the spin chamber thus depends on the position of the valve control element. When the valve control element fully withdraws the tapered surface from the orifice, the variable-geometry control is completed as further movement of the valve control element selectively unblocks increasing numbers of flow passages, admitting a correspondingly increased flow of liquid to enter the spray nozzle.

DESCRIPTION OF PREFERRED EMBODIMENT

Figure 1:
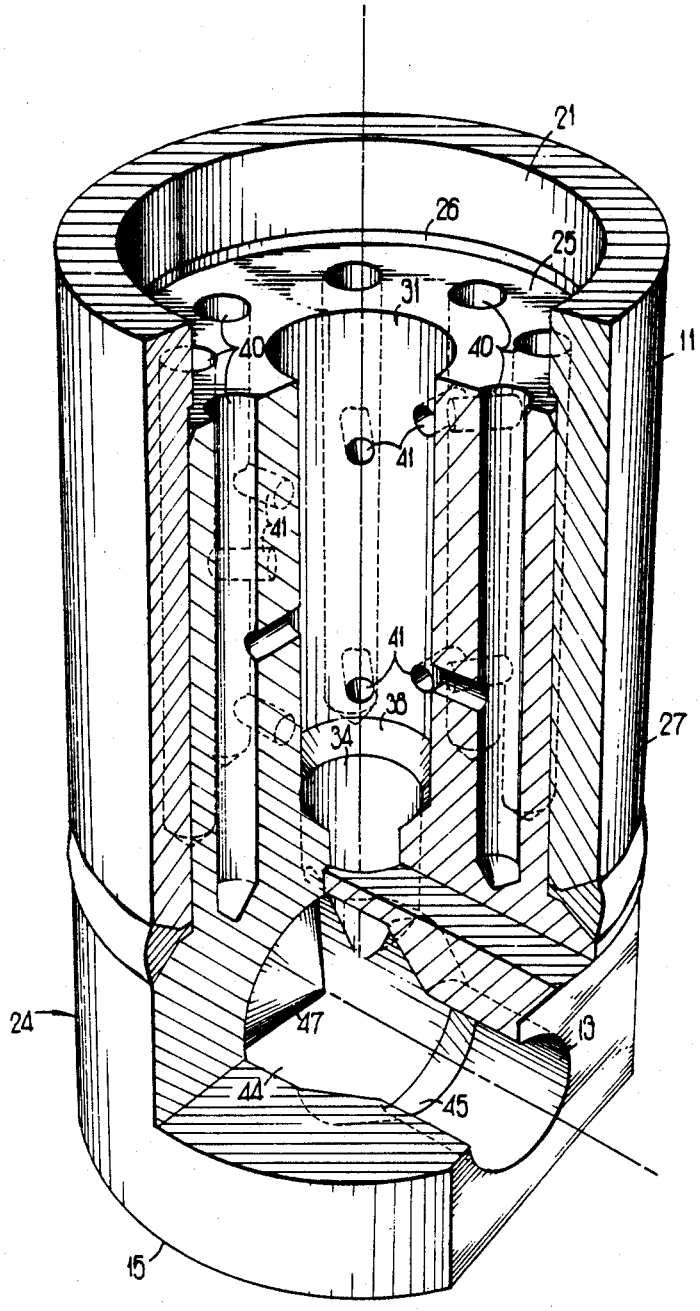
FIG. 1 is a sectioned partial pictorial view of a desuperheat apparatus with the valve plug removed for clarity of illustration, according to a preferred embodiment of the present invention.
Figure 2:
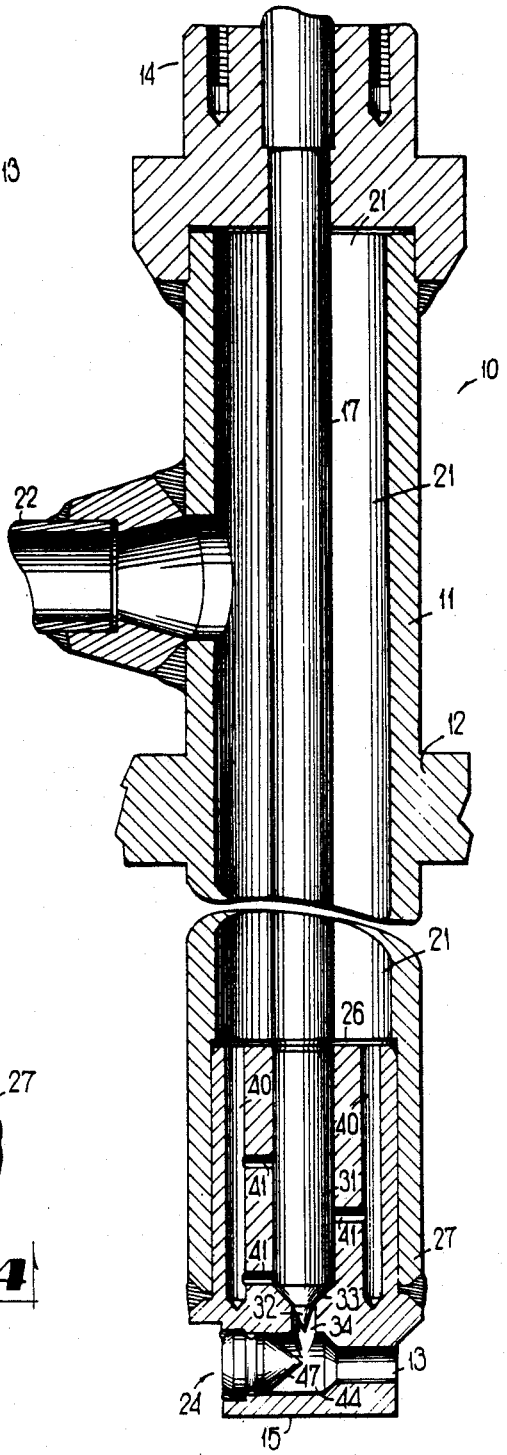
FIG. 2 is a broken sectioned elevation view of the apparatus in FIG. 1.

Turning first to FIGS. 1 and 2, there is shown generally at 10 a desuperheat apparatus including an elongated cylindrical housing 11 having an external mounting flange 12 approximately midway between the ends of the housing. The outlet 13 for the spray nozzle is located at one end of the housing 11, and has an axis perpendicular to the longitudinal axis of the housing. Another flange 14 is located at the other end of the housing 11, for attaching a suitable control actuator (not shown) or the like. This control actuator attaches in a known manner to the valve stem 17 axially located inside the housing 11 and occupying substantially less than the entire radial inner dimension within the housing. The housing 11, when in use, is attached to a tee-section of pipe in a steam system. The mounting flange 12 bolts to a mating flange on the tee, placing the spray nozzle 13 within the steam pipe disposed to direct a predetermined spray pattern of desuperheating water in the direction of the superheated steam flowing past the inner end 15 of the desuperheating apparatus.

The interior region 21 within the housing 11 is empty, except for the volume occupied by the valve stem 17, FIG. 2. An inlet pipe 22 is located on the side of the housing 11 a suitable distance above the flange 12. This inlet pipe 22 connects to a suitable water supply adequate for delivering desuperheat water at desired flow rates and at an appropriate supply pressure, as is known to those skilled in the art.

Figure 3:
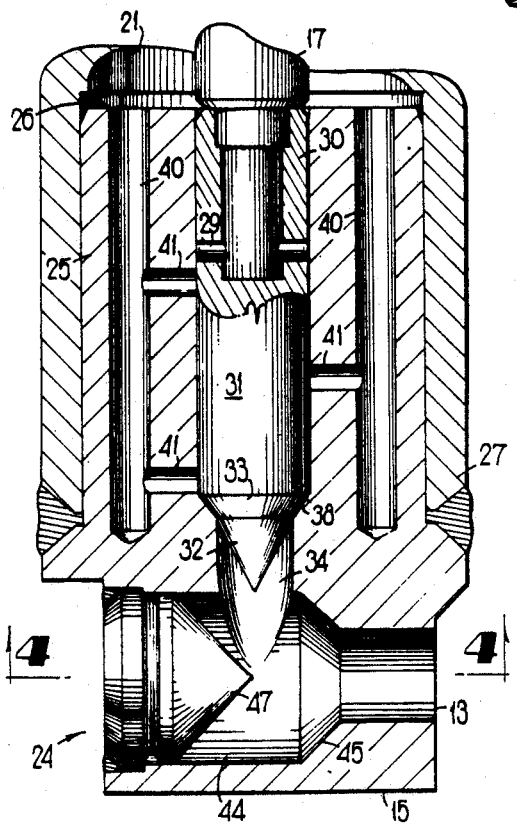
FIG. 3 is an enlarged sectioned view of the lower end portion of the disclosed apparatus.

The inner end 15 of the desuperheat apparatus is part of an end member 24 best shown in FIG. 3. The end member 24 has a cylindrical section 25 of reduced diameter, snugly fitting within a countersunk region 26 extending inwardly from the lower end 27 of the housing 11. The end member 24 is welded in place at the lower end 27 of the housing 11.

The cylindrical core 25 of the end member 24 has an elongated valve chamber 30 coaxial with the housing 11, and slidably receiving a valve plug 31. The valve plug 31 is attached to the lower end of the valve stem 17 by means of a connecting cross pin or the like, so that valve plug is reciprocally moved within the valve chamber 30 by moving the valve stem.

Figure 4:
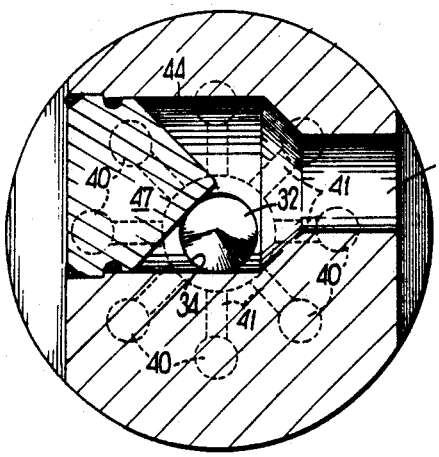
FIG. 4 is a sectioned view taken along line 4—4 of FIG. 3.

The valve plug 31 is cylindrical along most of its length, and has at its lower end the first and second tapered control surfaces 32 and 33. The lowermost first control surface 32 has the shape of a cone, and enters within the flow control orifice 34 at the lowermost end of the valve chamber 30. As best seen in FIGS. 3 and 4, the flow control orifice 34 is substantially cylindrical and does not necessarily contact the first tapered control surface 32 of the valve plug 31.

The second tapered control surface 33 on the valve plug is immediately above the first such surface 32, and defines a truncated cone seating on the mating tapered valve surface 38 at the lower end of the valve chamber 30 when the valve plug 31 is fully inserted in the valve chamber. The valve surface 38 engaged by the second tapered control surface 33 thus functions as a liquid flow shutoff, blocking all liquid flow through the flow control orifice 34 whenever the valve plug 31 occupies its lowermost position within the valve chamber 30.

A number of longitudinal manifold holes 40, paralleling the longitudinal axis of the valve chamber 30, are bored in the cylindrical core 25, radially located between the valve chamber 50 and the outside surface of the cylindrical core. The lower ends of the manifold holes 40 are blind, and the upper ends are open to the interior region 21 within the housing 11. Extending between the manifold holes 40 and the valve chamber 30 within the cylindrical core 25 are a number of radial flow passages 41. These flow passages 41 communicate with the interior surface defining the valve chamber 30, along a helical path of constant pitch extending upwardly from the lower end of the valve chamber. Thus, as the valve stem 17 withdraws the valve plug 31 from its lowermost position seating the valve surface 38, the valve plug uncovers the lower most flow passage 41 and then seriatim uncovers the other flow passages as upward movement of the valve plug continues. The cumulative cross-section area of unblocked flow passages 41 admitting water to the valve chamber 30 thus depends on the position of the valve plug 31 within the valve chamber. The valve plug 31 and valve chamber 30, together with the radial flow passages 41, thus form a liquid control valve of fixed geometry, in that the longitudinal movement of the valve plug increases or decreases the amount of water flow through the flow passages 41 (for a fixed water pressure at the inlet pipe 22) but does not affect the physical geometry of the valve chamber or the flow passages carrying this water.

Disposed in the end member 24 below the flow control orifice 34 is the spin chamber 44. The spin chamber 44 comprises a cylinder on a longitudinal axis perpendicular to the longitudinal axis of the flow control orifice 34. As best seen in FIGS. 3 and 4, the spin chamber 44 is laterally offset relative to the flow control orifice 34 to place the flow control orifice on a tangent to the cylindrical spin chamber. Liquid entering the spin chamber 44 through the flow control orifice 34 thus attains a spinning or swirling movement within the spin chamber.

The spin chamber 44 communicates with the spray nozzle outlet 13, which is coaxial with the spin chamber but of reduced diameter relative to the spin chamber. The diameter of the spin chamber 44 narrows along the region 45 before reaching the spray nozzle outlet 13. The spray nozzle 13 itself preferably comprises a cylindrical bore having an abrupt transition at the outer surface of the end member 24, so as to promote a spray pattern in the shape of an open cone as described below.

A conical deflector 47 is located at the inner end of the spin chamber 44. This conical deflector 47 in the disclosed embodiment is formed at one end of a plug member 48 inserted within an open bore comprising the spin chamber 44, and then welded in place within that bore. The conical deflector 47 is angled to deflect the inflowing water, arriving on a path perpendicular to the longitudinal axis of the spin chamber 44, toward the spray nozzle outlet 13.

The operation of the desuperheat apparatus 10 is now described, assuming the apparatus is mounted in a steam line and the inlet pipe 22 is connected to a water supply capable of maintaining the maximum flow through the desuperheat apparatus while maintaining a constant water pressure at the inlet pipe. The water enters the interior region 21 of the housing 11, filling the manifold holes 40 and entering the flow passages 41, but not flowing into the valve chamber 30 as long as the valve plug 31 remains seated in the valve chamber with the second control surface 33 seated on the valve surface 38.

Figure 5:
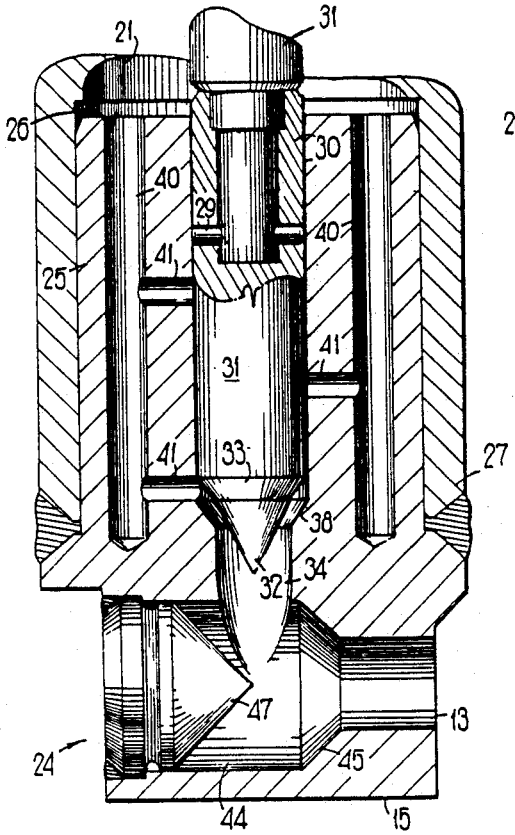
FIG. 5 is a view as in FIG. 3, showing the variable-geometry orifice partially opened.

Desuperheat spray operation commences when the valve plug 31 is moved away from the fully-seated position under control of the valve stem 17 and a suitable control actuator. The initial portion of the movement or stroke for the valve plug 31 takes place as the first tapered control surface 32 is withdrawn from the flow control orifice 34; FIG. 5 illustrates this operation. The effective cross-section flow area of the orifice 34 increases as the first control surface 32 is further withdrawn from the orifice. At least one flow passage 41 leading from a manifold hole 40 to the valve chamber 31 is uncovered during this initial movement of the valve plug 31. After the first control surface 32 of the valve plug 31 is fully withdrawn from the flow control orifice 34, further outward movement of the valve plug 31 serially uncovers more of the remaining flow passages 41, increasing the amount of water flowing from the inlet pipe 22 into the valve chamber 30. The operation of the desuperheat apparatus during both the initial or spincontrol portion of the valve plug stroke while the first control surface 32 is in the flow control orifice 34, and the final or pressure-control portion of that stroke while the first control surface is outside the flow control orifice, is now discussed.

Figure 6:
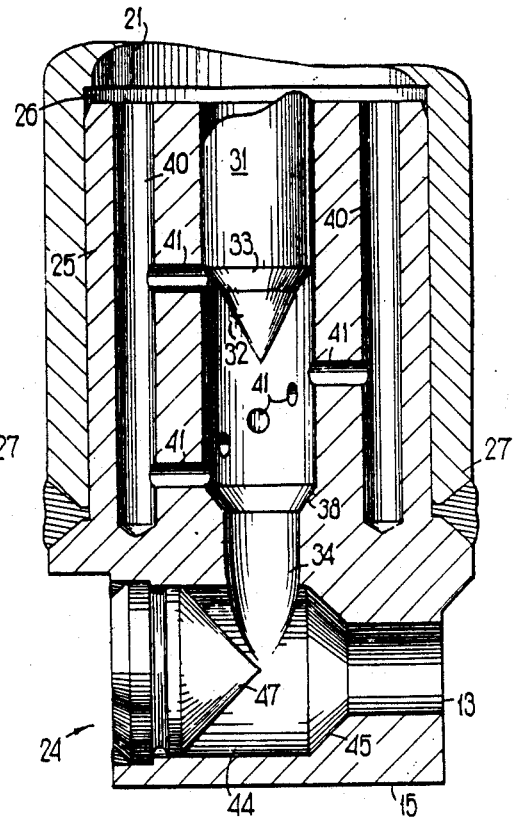
FIG. 6 is a view as in FIG. 3, showing the variable-geometry orifice fully open and the fixed-geometry control element partially open.

The first control surface 32 becomes fully withdrawn from the flow control orifice 34 when the flow of water through the flow control orifice is sufficient to maintain the desired spray dispersion pattern at the nozzle outlet 13. This takes place when the rate of flow is sufficient to provide the minimum pressure drop across the nozzle outlet 13 required to produce the desired spray pattern, typically a hollow cone-shaped pattern. This minimum rate of water flow initiates the pressure-control operation of the nozzle, and is determined by known parameters principally including the diameter of the nozzle outlet 13. The length and radial dimensions of the flow control orifice 34, and the diameter of the flow passages 41 and the number of those flow passages uncovered by the valve plug 31 when the first control surface 32 is just completely withdrawn from the flow control orifice 34, together with the maximum flow rate and supply pressure available to the inlet pipe 22, are parameters used by one of ordinary skill to select the dimensions of the flow control orifice 34 and the stroke length for the valve plug 31 required to reach the pressure control region, namely, when the first control surface 32 is just completely withdrawn from the flow control orifice 34. Once the pressure control portion of the valve stroke is reached, further withdrawing the valve plug 31 from the valve chamber 30 as shown in FIG. 6 uncovers additional flow passages 41, increasing the water flow rate to the nozzle outlet 13 and thus increasing the water volume delivered to desuperheat steam.

When the desuperheat apparatus 10 is throttled down by moving the valve stem 17 inwardly to the point where the first control surface 32 enters the flow control orifice 34, the water flow is reduced below the minimum flow normally required to maintain adequate pressure drop across the spray nozzle 13. However, the first control surface 32 reduces the effective flow area of the orifice 34, causing a corresponding increase in the velocity of the water flowing through the now partly-blocked orifice. In effect, constricting the flow control orifice 34 creates behind that orifice a back pressure increasing the water velocity through the orifice. This increased-velocity flow tangentially enters the spin chamber 44, increasing the velocity of the swirling or spinning movement of the water within the spin chamber. This spinning water in the spin chamber 44 flows toward the spray nozzle outlet 13, and the conical deflector 47 located in the spin chamber helps transition the direction of liquid flow from the flow control orifice to the spray nozzle outlet 13. The increased velocity of water flowing through the constricted flow control orifice 34, as well as the increased spin velocity imparted to that water in the spin chamber 44, maintains the desired hollow cone spray pattern at the spray nozzle outlet 13 notwithstanding the reduced rate of water flow.

As the volume of water flow is further reduced by lowering the valve plug to place the first control surface 32 further within the flow control orifice 34, the velocity of water flowing through that orifice into the spin chamber 44 commensurately increases. The first control surface 32 and the flow control orifice 34 thus comprise a variable-geometry control which increases the velocity of water flowing tangentially into the spin chamber 44, as the volume of flow decreases. This increased velocity, provided by the variable geometry flow control and the spin imparted to the water, maintains the hollow cone spray pattern at the spray nozzle outlet 13, throughout lower flow rates well below the lower extent of the pressure control region mentioned above.

Figure 7:
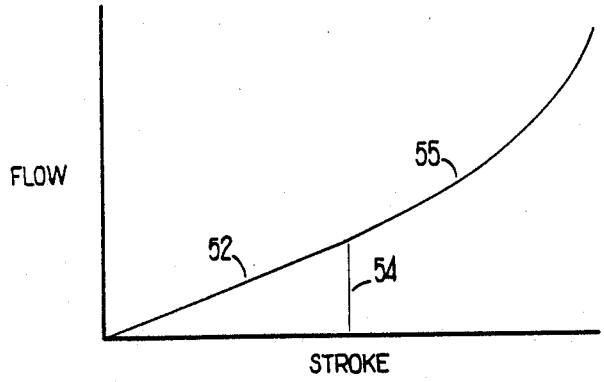
FIG. 7 is a graph of flow vs. valve member stroke for the disclosed embodiment.

The combined flow control over the initial or spin control portion, and the final or pressure control portion of desuperheat operation, is depicted graphically in FIG. 7. The horizontal axis represents the stroke or displacement of the valve plug 31, with the fully-closed position corresponding to the intersection of horizontal and vertical axes. The vertical axis represents the rate of water flow through the desuperheat apparatus. During the initial or spin control portion 52 of the stroke, water flow increases at a relatively linear relation to the stroke of the valve plug 31. This linear relation is a function of the linearly-variable geometry of the spin control valve structure in the disclosed embodiment.

The transition between spin control and pressure control, where the first control surface 32 is just completely withdrawn from the flow control orifice 34, is represented at location 54 in FIG. 7. The stroke vs. flow curve 55 beyond the transition 54 is relatively nonlinear, reflecting the pressure control of water flow through the nozzle outlet 13 notwithstanding a linear relation between the number of flow passages 41 uncovered per increment of movement of the valve plug 31 throughout the pressure control portion of operation.

The spray desuperheater described above thus provides a substantially uniform spray pattern over a full range of operation including relatively low rates of flow, with a single spray nozzle. This spray pattern is maintained through spin control over the relatively low flow rates, and by pressure control at higher flow rates over the remainder of the full range of operation. Spin is imparted to the water flowing through the spin chamber 44 at the higher flow rates, as well as the lower flows, but this spin does not hinder operation in the pressure control region and may enhance the dispersion and droplet size. A single movable valve element thus provides variable-geometry flow control for the lower rates of flow, as well as fixed-geometry control of volume over the pressure control region of operation.

It should be understood that the foregoing relates only to a preferred embodiment of the present invention, and that numerous changes and modifications to this embodiment may be made without departing from the spirit and scope of the invention as defined in the following claims.

I claim:

1. A desuperheat flow control valve comprising:

a liquid flow passage for receiving a supply of desuperheat liquid;

a first flow control means of variable geometry disposed in said passage and selectively operable to vary the flow of liquid permitted through the passage through a first flow range up to a predetermined first maximum flow;

a second flow control means of fixed geometry disposed in said passage and selectably operable to vary the flow of liquid received by the first flow control means through a second range from said first maximum up to a second maximum flow which exceeds said first maximum;

spin flow means downstream from the first flow control means so as to receive the liquid flowing through said first and second flow control means;

a spray nozzle of fixed geometry downstream from the spin flow means and operative to produce a predetermined spray pattern in response to flow rates in the second range, but not in response to flow rates less than the first maximum flow, said spin flow means imparting to said liquid flow a spin motion sufficient to exit the spray nozzle as a hollow cone spray; and wherein the variable geometry of said first flow control means is operative to increase the velocity of liquid flowing therethrough in response to operation of the second flow control means to reduce the flow rate below the first maximum flow, so that the liquid flows to said spin flow means at an increased velocity sufficient to provide said spin motion throughout said first range of flows and the spray nozzle can produce the spray pattern in the first range of flows.

2. A desuperheat flow control valve comprising:

spray-nozzle means of fixed geometry receiving a liquid inflow and delivering a certain spray dispersion pattern in response to liquid flowing at a certain flow rate producing at least a minimum back pressure across the spray nozzle means;

flow control means associated with said spray nozzle means for selectively delivering liquid thereto over a range of flow rates including rates insufficient to maintain said minimum pressure at the spray nozzle means;

means downstream from the flow control means to receive the liquid flowing past said flow control means and impart a spin movement to the liquid flowing to said spray nozzle means, so that the spray nozzle means disperses a spray pattern in the shape of a hollow cone; and said flow control means comprising variable geometry means operative to increase the velocity of liquid flowing therethrough in response to decreasing the flow rate to said insufficient rates, so that the liquid flows through said spin imparting means to reach the spray nozzle means at an increased velocity which provides the desired dispersion pattern notwithstanding the insufficient rate of flow.

3. A desuperheat flow control valve as in claim 2, wherein:

said spin imparting means comprises a hollow cylindrical flow passage axially aligned at a substantial angle to the direction of liquid entering the cylindrical flow passage through said flow control means;

said liquid flow entering said cylindrical flow passage substantially tangent to the cylindrical passage, thereby imparting spin movement to the liquid flow; and said cylindrical flow passage leading to said spray nozzle means.

4. A desuperheat flow control valve as in claim 3, wherein said cylindrical flow passage constricts to accelerate the spinning liquid flowing to said spray nozzle means, thereby further increasing the velocity of the liquid for the hollow cone dispersion pattern produced by the spray nozzle means.

5. A desuperheat flow control valve as in claim 3, further comprising:

a conical deflector axially disposed in said cylindrical flow passage to axially deflect the liquid tangentially entering the flow passage.

6. A desuperheat flow control valve as in claim 2, wherein:

said variable geometry means selectively varies the velocity of liquid flow in response to liquid delivery by the flow control means over a lower first range of flows at least up to an intermediate flow sufficient to maintain said minimum back pressure at the spray nozzle means; and wherein said flow control means further comprises a fixed geometry means selectively operative when the flow through the variable geometry means reaches said intermediate flow to vary the rate of liquid flow over a second range of flows higher than said first range.

7. A desuperheat flow control valve as in claim 6, wherein:

said variable geometry means and said fixed geometry means comprise separate control surfaces of a control element selectively movable to control liquid flow seriatim through said first and second ranges; and the variable geometry means increases the velocity of liquid flow in inverse relation to the volume of liquid flow, in response to movement of the control element to control liquid flow through the first range.

8. A desuperheat flow control valve as in claim 2, wherein: .

said variable geometry means comprises an orifice through which passes the liquid flowing to said spray nozzle means;

a control element selectively movable to vary the effective flow area of said orifice while in said insufficient rates of flow; and said orifice and control element providing flow areas which maintain the liquid velocity through the orifice at said increased velocity providing the desired spray dispersion over a range of insufficient rates of liquid flowing through the orifice.

9. A desuperheat flow control valve as in claim 8, further comprising:

a flow control valve upstream of the orifice and control element;

a second control element selectively movable to vary the volume of liquid flowing through said flow control valve; and said first and second control elements being operatively interconnected so that the first control element provides the maximum flow area for the first orifice when the second control means provides a flow rate through the flow control valve at least sufficient to maintain said minimum back pressure at the spray nozzle means.

10. A desuperheat flow control valve as in claim 3, wherein:

said variable geometry means comprises an orifice through which passes the liquid tangentially entering said cylindrical flow passage; and further comprising a control element selectively movable to vary the effective flow area of said orifice in said insufficient rates of flow; and said control element cooperating with the orifice to provide flow areas which maintain the liquid velocity through the orifice at least at said increased velocity, for a range of the insufficient rates of liquid flowing through the orifice.

11. A desuperheat flow control valve as in claim 10, further comprising: a flow control valve upstream of the orifice;

a second control element selectively movable to vary the volume of liquid flowing through said flow control valve; and said first and second control elements being operatively interdependent so that the first control element provides the maximum flow area for the orifice when the second control means provides flow rates through the flow control valve at least sufficient to maintain said minimum velocity back pressure at the spray nozzle means.

12. A desuperheat flow control valve comprising:

means defining an elongated chamber having an outlet end;

a water manifold surrounding said elongated chamber;

a first control element disposed within the elongated chamber for selective movement ranging between first and second positions relative to said outlet end;

means establishing liquid flow communication from said water manifold to the interior of said elongated chamber at plural inlet locations between said first and second positions;

said first control element at said first position substantially blocking flow from said inlet locations, and progressively unblocking said flow means and permitting progressively increased liquid flow from the inlet locations into the elongated chamber as the first control element moves progressively from the first position to said second position;

a variable geometry orifice in liquid flow communication with the outlet end of the elongated chamber and including a second control element operatively associated with said first control element to vary the flow area of said orifice in response to movement of the first control element over a first portion of said movement range;

said orifice being at maximum flow area as the first control element moves over a second portion of said movement range;

a cylindrical flow passage downstream from the variable geometry orifice to receive the liquid flow through said orifice in a direction substantially tangent to the cylindrical passage, thereby imparting a spin movement to the liquid flowing through the cylindrical passage; and a spray nozzle of fixed geometry downstream from the cylindrical flow passage and receiving the spinning liquid flow so as to produce a certain spray dispersion pattern in response to liquid flowing at a minimum back pressure across the spray nozzle;

the variable flow controlled by said first control element over said first portion of the movement range being too low to produce said spray dispersion pattern and over the second portion of said movement range being sufficient to produce said spray dispersion pattern at said spray nozzle; and said second control element varying the geometry of said orifice to increase the liquid velocity flowing therethrough as the first control element moves over the first portion of the movement range to decrease the liquid flow, thereby increasing the velocity of flow at said spray nozzle so as to maintain the spray dispersion pattern.

13. A desuperheat flow control valve as in claim 12, further comprising:

a conical deflector axially disposed in said cylindrical flow passage for deflecting the spinning flow of liquid toward said spray nozzle.

14. A desuperheat flow control valve as in claim 13, wherein:

said cylindrical flow passage constricts leading to said spray nozzle, so as to further increase the velocity of the spinning liquid flow to the nozzle.

15. A desuperheat flow control valve comprising:

a spray nozzle operative to produce a predetermined pattern of liquid spray in response to at least a predetermined minimum liquid flow supplied to the spray nozzle;

an orifice of predetermined size located upstream in a liquid flow path to the spray nozzle;

a spin chamber disposed downstream from the orifice and upstream from the spray nozzle and operative to impart an axial spinning movement to the liquid flowing from the orifice toward the spray nozzle;

a flow control valve located upstream of the orifice and selectively operative to vary the flow of liquid supplied to the orifice over a range of flows including flows less than said predetermined minimum flow required by the spray nozzle;

an orifice control element operatively associated with the flow control valve to selectively restrict the orifice in response to selected flows less than the predetermined minimum, so that the restriction of the orifice increases the velocity of the lessened flow to the spray nozzle sufficiently to maintain the liquid spray pattern produced by the spray nozzle in response to flow rates less than the predetermined minimum flow; wherein, the spray nozzle produces the spray pattern in response to a minimum liquid flow operative to provide at least a minimum pressure drop across the nozzle; and the orifice control element is operative to enter the orifice and restrict liquid flow therethrough in response to operation of the flow control valve which reduces the liquid flow below the minimum flow, thereby increasing the velocity of liquid flowing to the spin chamber so as to maintain the spray pattern.

* * * * *